US008436285B2

(12) United States Patent
Corradini

(10) Patent No.: US 8,436,285 B2
(45) Date of Patent: May 7, 2013

(54) PROJECTILE THAT INCLUDES A FIN ADJUSTMENT MECHANISM WITH CHANGING BACKLASH

(75) Inventor: John Corradini, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 284 days.

(21) Appl. No.: 12/843,335

(22) Filed: Jul. 26, 2010

(65) Prior Publication Data

US 2012/0211594 A1 Aug. 23, 2012

(51) Int. Cl.
*F42B 15/01* (2006.01)

(52) U.S. Cl.
USPC ..... 244/3.24; 244/3.21

(58) Field of Classification Search ..... 244/3.1, 244/3.21, 3.23, 3.24, 3.27, 3.28, 3.29; 102/473, 102/501
See application file for complete search history.

(56) References Cited

U.S. PATENT DOCUMENTS

| | | | | |
|---|---|---|---|---|
| 4,099,683 | A * | 7/1978 | Stouffer et al. | 242/375.3 |
| 5,806,791 | A | 9/1998 | Hatalsky et al. | |
| 5,829,715 | A * | 11/1998 | Banks | 244/49 |
| 6,073,880 | A * | 6/2000 | Voigt et al. | 244/3.28 |
| 6,247,666 | B1 * | 6/2001 | Baker et al. | 244/3.21 |
| 6,848,648 | B2 | 2/2005 | Klestadt et al. | |
| 7,246,539 | B2 * | 7/2007 | Turner | 74/665 N |
| 7,906,749 | B2 * | 3/2011 | Fjerstad | 244/3.24 |
| 2004/0144888 | A1 | 7/2004 | Dryer et al. | |
| 2007/0007383 | A1 * | 1/2007 | Hsu et al. | 244/3.24 |
| 2008/0001023 | A1 * | 1/2008 | Schroeder | 244/3.24 |
| 2008/0029641 | A1 * | 2/2008 | Carlson et al. | 244/3.24 |
| 2010/0147992 | A1 | 6/2010 | Mock | |

FOREIGN PATENT DOCUMENTS

WO WO-2012/044340 A2 4/2012

OTHER PUBLICATIONS

"International Application Serial No. PCT/US2011/00945, International Search Report mailed Mar. 20, 2012", 2 pgs.
"International Application Serial No, PCT/US2011/00945, Written Opinion mailed Mar. 20, 2012", 5 pgs.

* cited by examiner

*Primary Examiner* — Christopher P Ellis
*Assistant Examiner* — Medhat Badawi
(74) *Attorney, Agent, or Firm* — Schwegman Lundberg & Woessner, P.A.

(57) ABSTRACT

Some embodiments pertain to a projectile that includes a casing and at least one fin that extends from the casing. The projectile further includes a drive inside the casing and an adjustment mechanism inside the casing. The adjustment mechanism includes a first gear that engages the drive and a second gear that engages the fin and the first gear. The second gear includes teeth that are different distances from an axis of rotation of the second gear. The teeth of the second gear that engage the first gear may be the farthest from the axis of rotation of the second gear when the fin is aligned with a flight axis of the projectile. The engaging teeth of the second gear get closer to the axis of rotation of the second gear as the fin is maneuvered away from the flight axis of the projectile.

7 Claims, 11 Drawing Sheets

PROJECTILE THAT INCLUDES A FIN ADJUSTMENT MECHANISM WITH CHANGING BACKLASH

TECHNICAL FIELD

Embodiments pertain to a projectile that includes fins, and more particularly to a projectile that includes a fin adjustment mechanism with changing backlash.

BACKGROUND

Many projectiles include fins that are used to maneuver the projectile during flight. The fins are usually adjusted using some form of adjustment mechanism.

Many adjustment mechanisms typically include a gear system that is engaged with a drive that turns the gears. The gears are also engaged with the fin such that when the drive turns the gears, the fin is adjusted.

One of the drawbacks with existing adjustment mechanisms is that they are typically be designed and manufactured with tight tolerances and stiffer designs which make them relatively expensive to produce. The expense can be significant because the gears in existing adjustment mechanisms need to be run-in and measured in a variety of environments.

During flight of the projectile the fins are placed under relatively high aerodynamic loads when the projectile needs to be maneuvered by the fins. A fin maneuvers the projectile by moving from a neutral state (where the aerodynamic load is at a minimum) during flight in one direction or another depending on which way the projectile needs to be maneuvered.

The tight tolerances of existing adjustment mechanisms within the projectile can be problematic when the fin is placed under relatively high aerodynamic loads during flight. The combination of a relatively high aerodynamic load on the fins and overall tightness of the gears in the adjustment mechanism often causes the adjustment mechanisms to bind up during operation. The binding up problem is not as great when the fin is in a neutral position during flight because there is a lower aerodynamic load.

DETAILED DESCRIPTION

Figure 1:
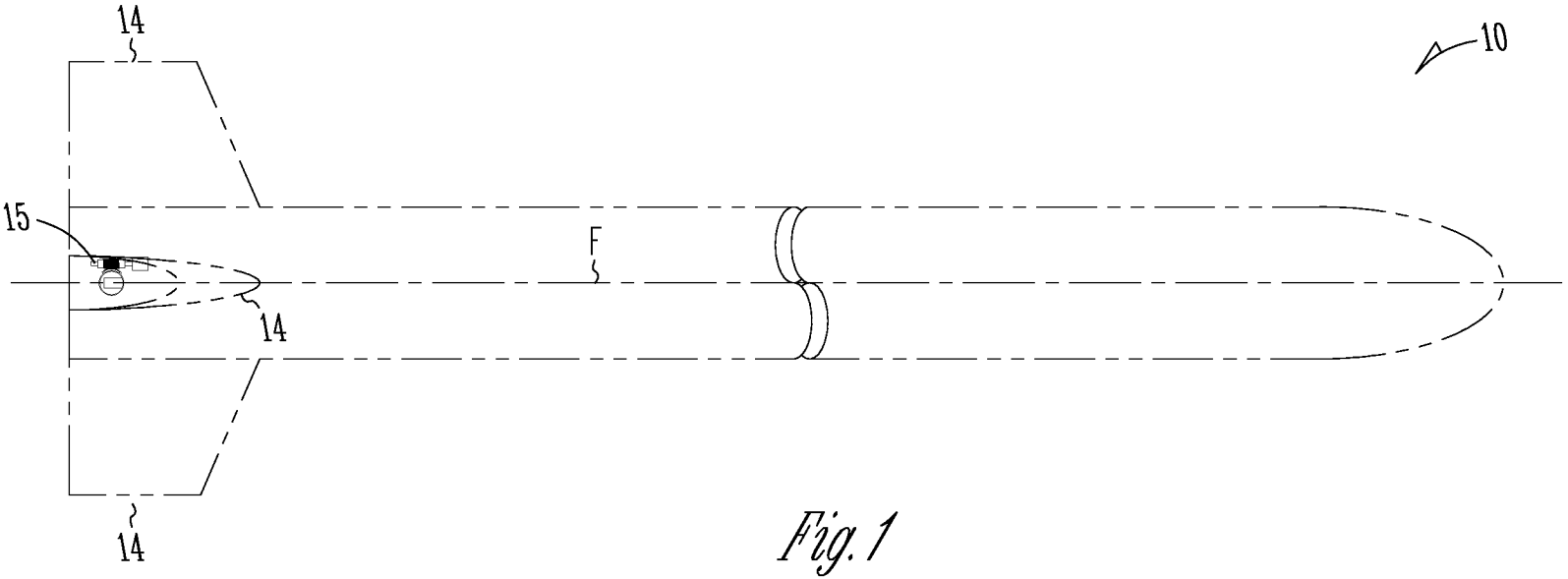
FIG. 1 is a side view of an example projectile in accordance with some embodiments.

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

As used herein, fins are meant to include any surface that generates aerodynamic forces and/or moments. Some example terms for such surfaces include tail, fin, wing, strake or canard (among others).

As used herein, projectile refers to missiles, guided projectiles, gliders, unguided projectiles and sub-munitions.

FIGS. 1-7 illustrate an example projectile 10. The projectile 10 includes a casing 12 and at least one fin 14 that extends from the casing 12. The projectile 10 further includes a drive 13 inside the casing 12 and an adjustment mechanism 15 inside the casing 12. The adjustment mechanism 15 includes a first gear 16 that engages the drive 13 and a second gear 18 that engages the fin 14 and the first gear 16. The second gear 18 includes teeth 20 that are different distances from an axis of rotation R of the second gear 18.

During flight of the projectile 10, the fin 14 will have a range of motion where backlash is a concern when the fin is in a neutral position (see FIGS. 2 and 5) and aerodynamic loads are lower. When the fins 14 are positioned at larger steering angles during flight of the projectile 10, the fins 14 are subjected to higher aerodynamic loads (see FIGS. 3-4 and 6-7). These higher loads cause the fin 14 to get biased in one direction depending on the direction of the load. Therefore, backlash is less of a concern when the fin is subjected to relatively high aerodynamic loads at larger steering angles.

Figure 5:
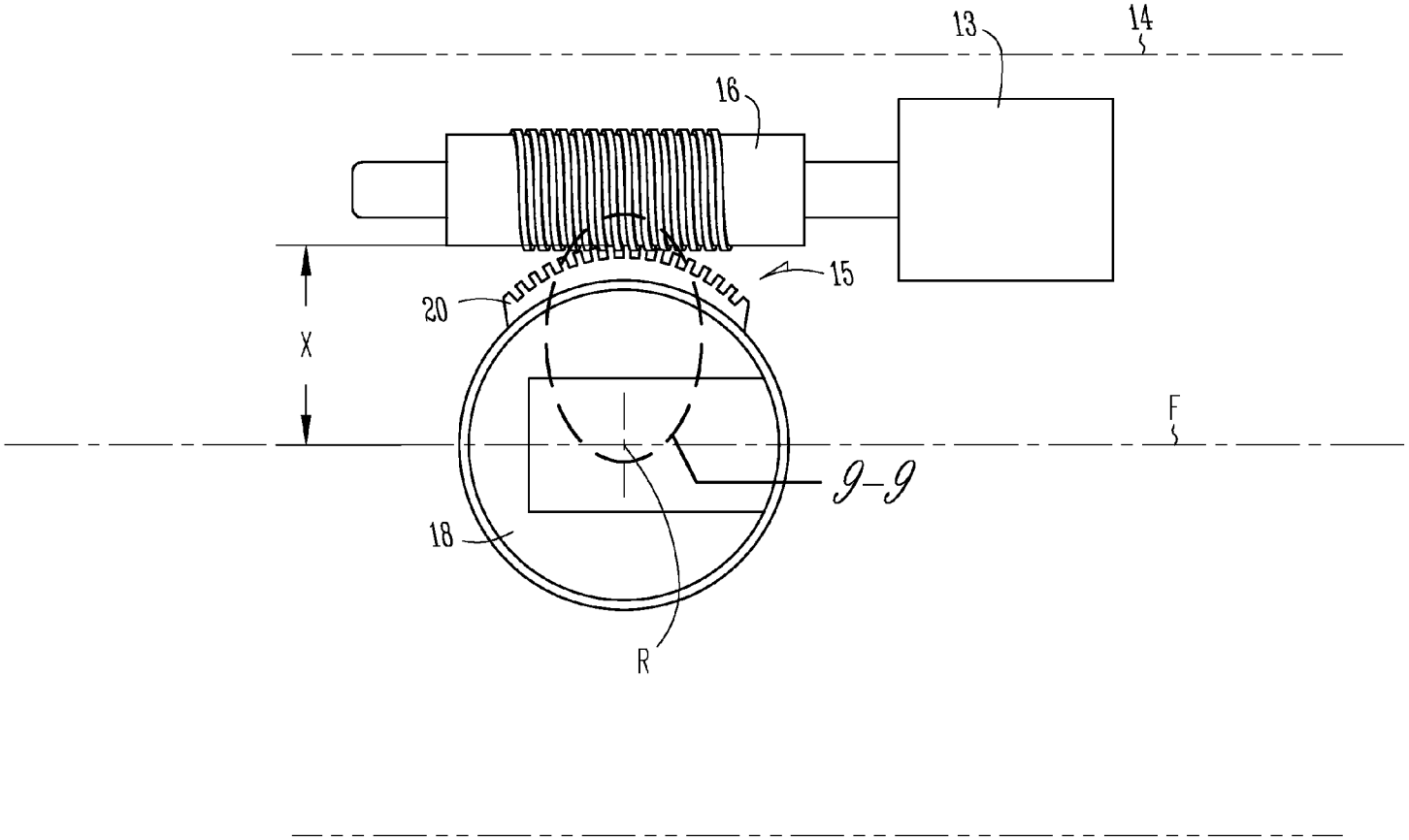
FIG. 5 is a further enlarged view of the adjustment mechanism shown in FIG. 2 with the fin in a neutral position in accordance with some embodiments.
Figure 6:
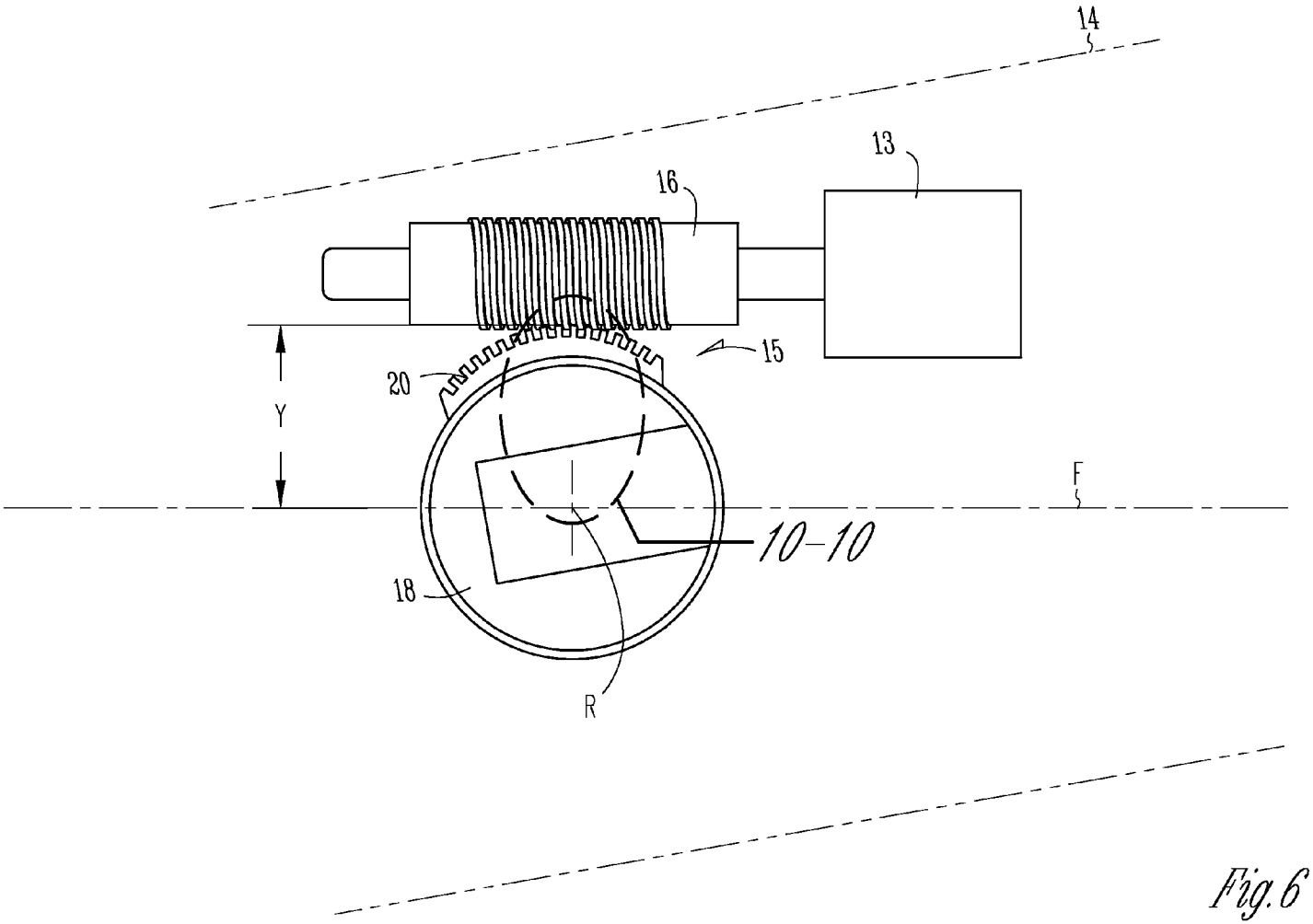
FIG. 6 is a further enlarged view of the adjustment mechanism shown in FIG. 3 with the fin in an adjusted position in accordance with some embodiments.
Figure 7:
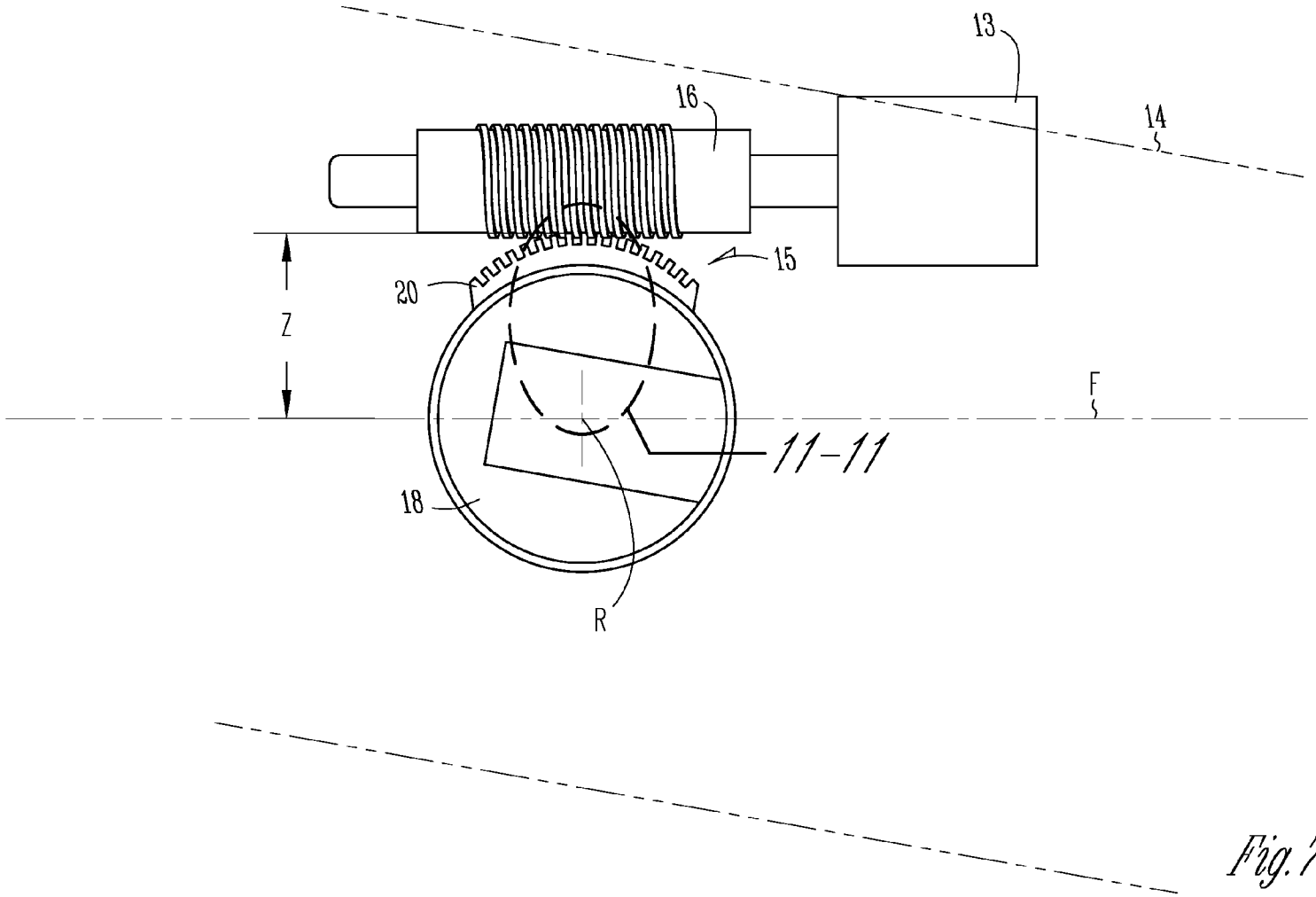
FIG. 7 is a further enlarged view of the adjustment mechanism shown in FIG. 4 with the fin in an adjusted position in accordance with some embodiments.
Figure 10:
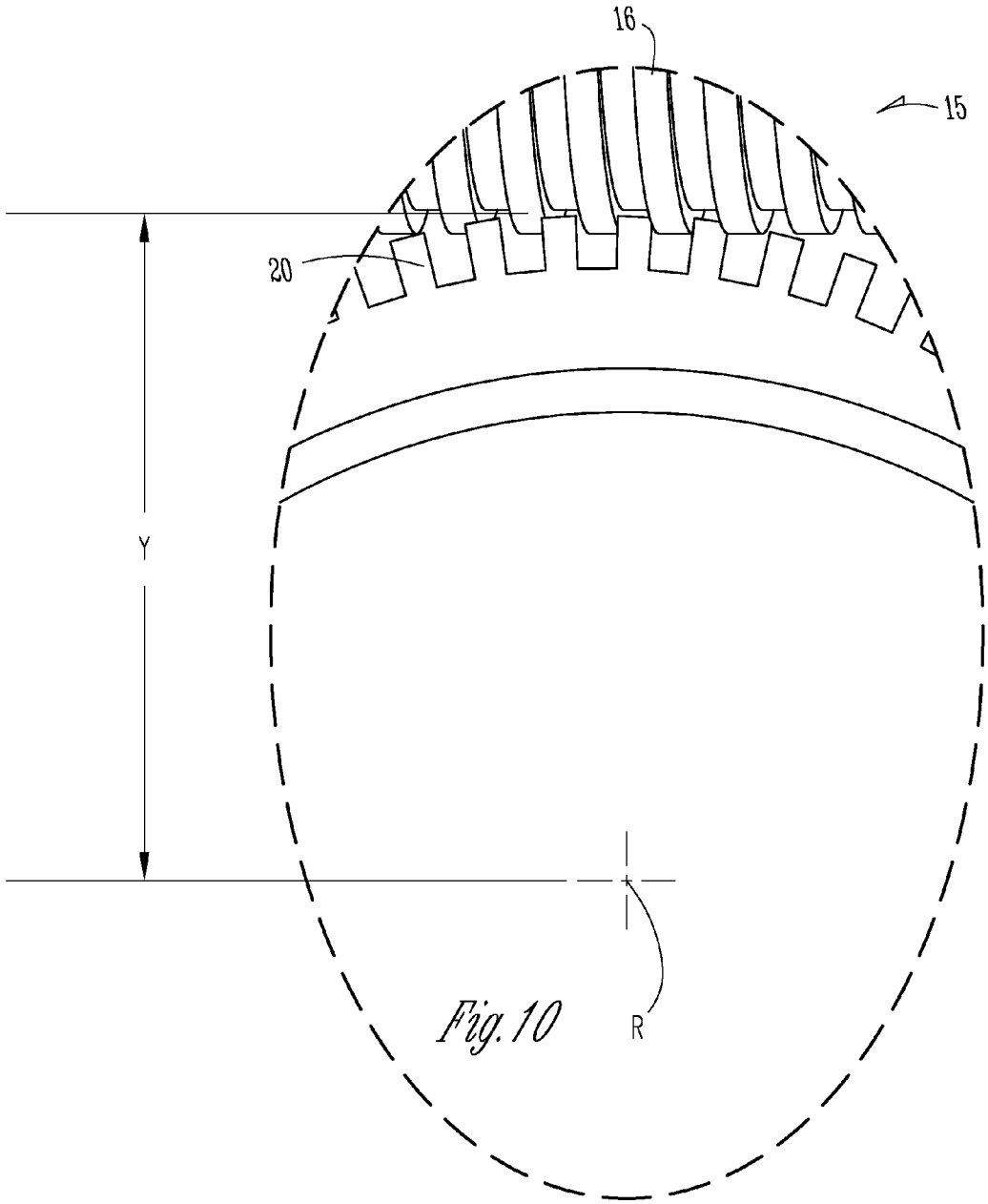
FIG. 10 is a further enlarged view of the example adjustment mechanism shown in FIG. 6.
Figure 11:
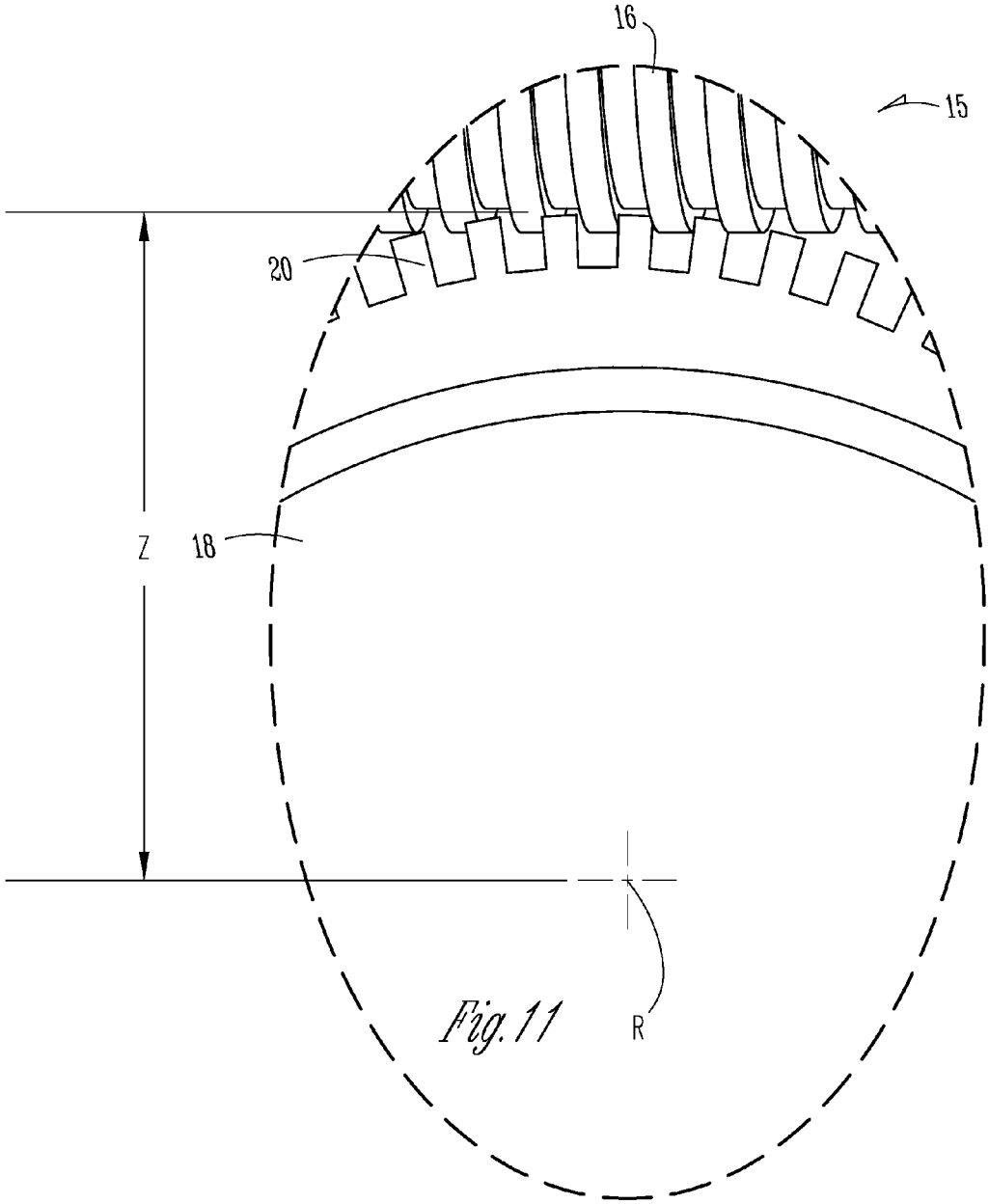
FIG. 11 is a further enlarged view of the example adjustment mechanism shown in FIG. 5.

In the illustrated example embodiments, the teeth 20 of the second gear 18 that engage the first gear 16 are the farthest from the axis of rotation R of the second gear 18 when the fin 14 is aligned with a flight axis F of the projectile 10 (see dimension X shown most clearly in FIG. 5). As shown in FIGS. 6 and 7, the engaging teeth 20 of the second gear 18 get closer to the axis of rotation R of the second gear 18 as the fin is maneuvered away from the flight axis F of the projectile 10. As shown most clearly in FIGS. 9-11, dimensions Y and Z in FIGS. 10 and 11 are smaller than dimension X in FIG. 9.

Figure 2:
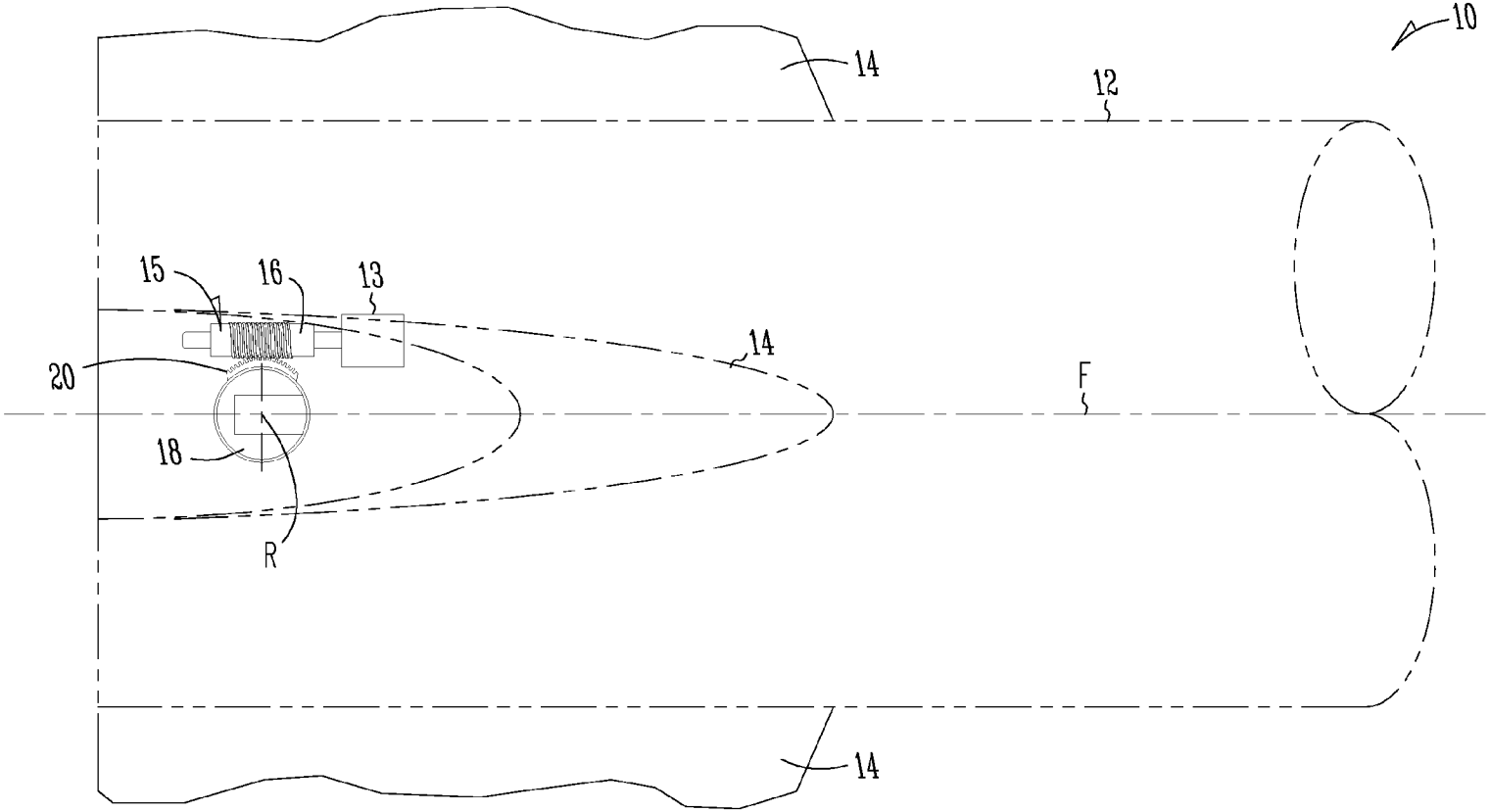
FIG. 2 is an enlarged view of the rear of the projectile shown in FIG. 1 with the fins in a neutral position in accordance with some embodiments.
Figure 3:
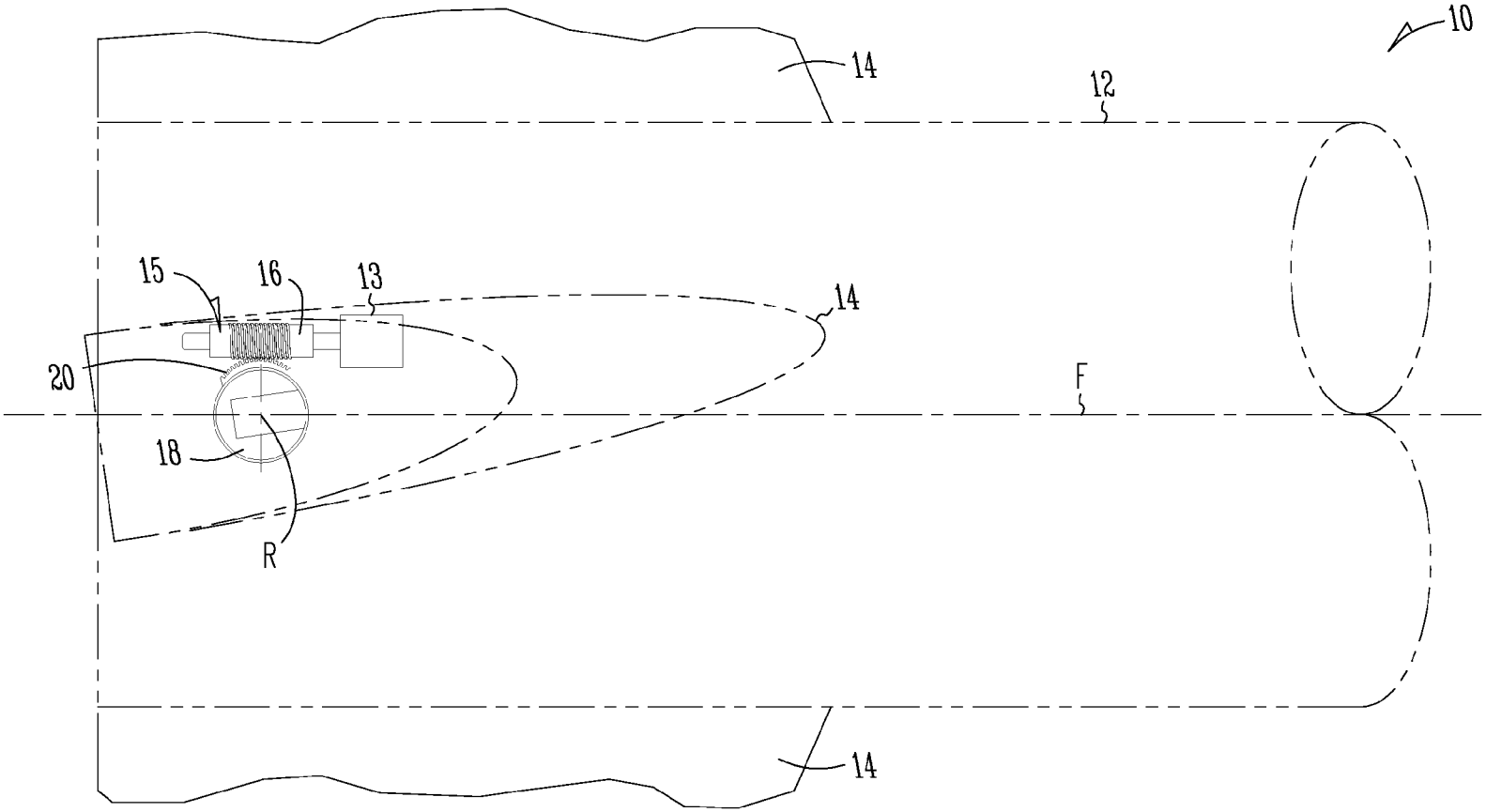
FIG. 3 is an enlarged view of the rear of the projectile shown in FIG. 1 with the fins in an adjusted position in accordance with some embodiments.
Figure 4:
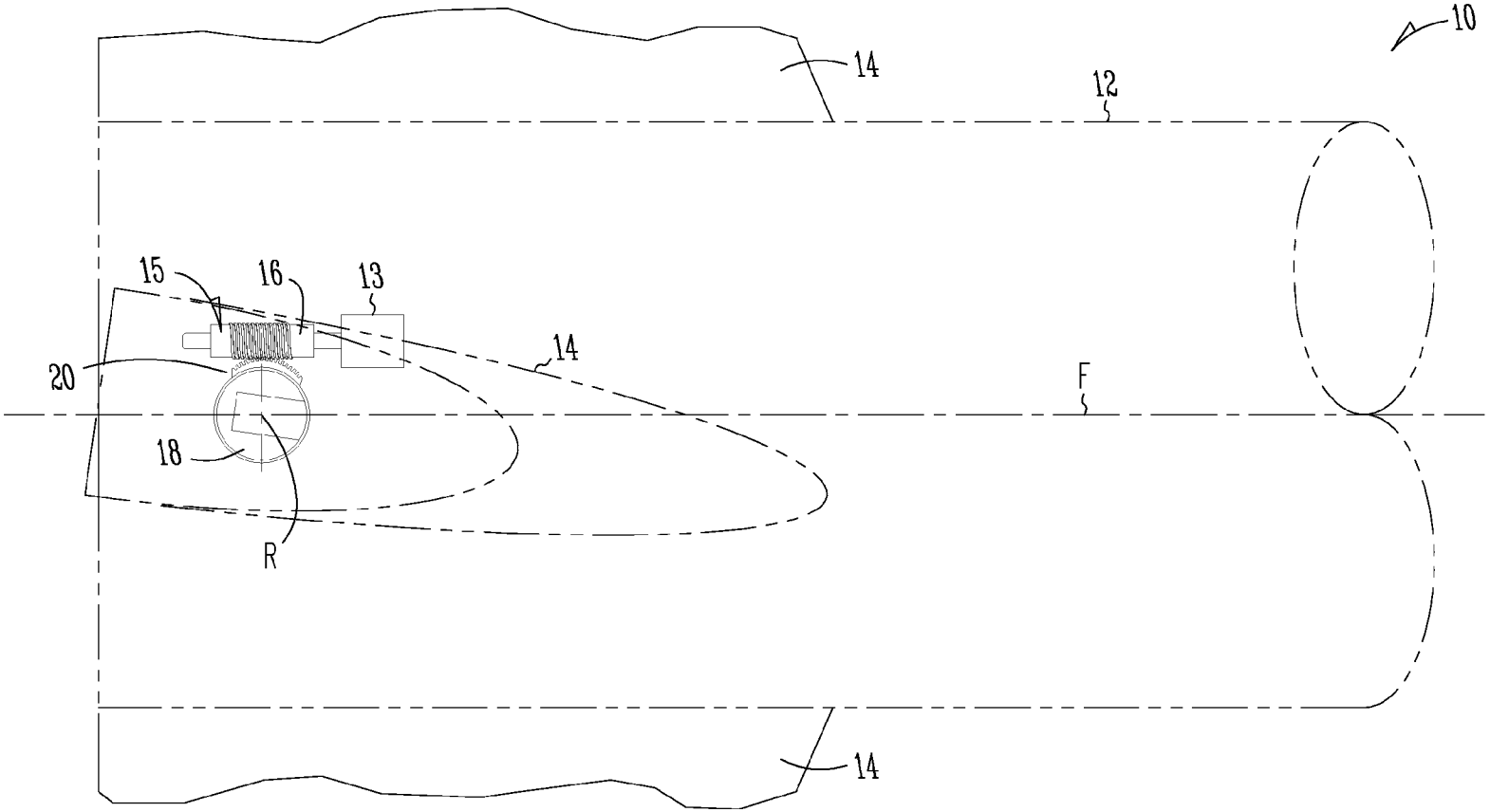
FIG. 4 is an enlarged view of the rear of the projectile shown in FIG. 1 with the fins in another adjusted position in accordance with some embodiments.
Figure 9:
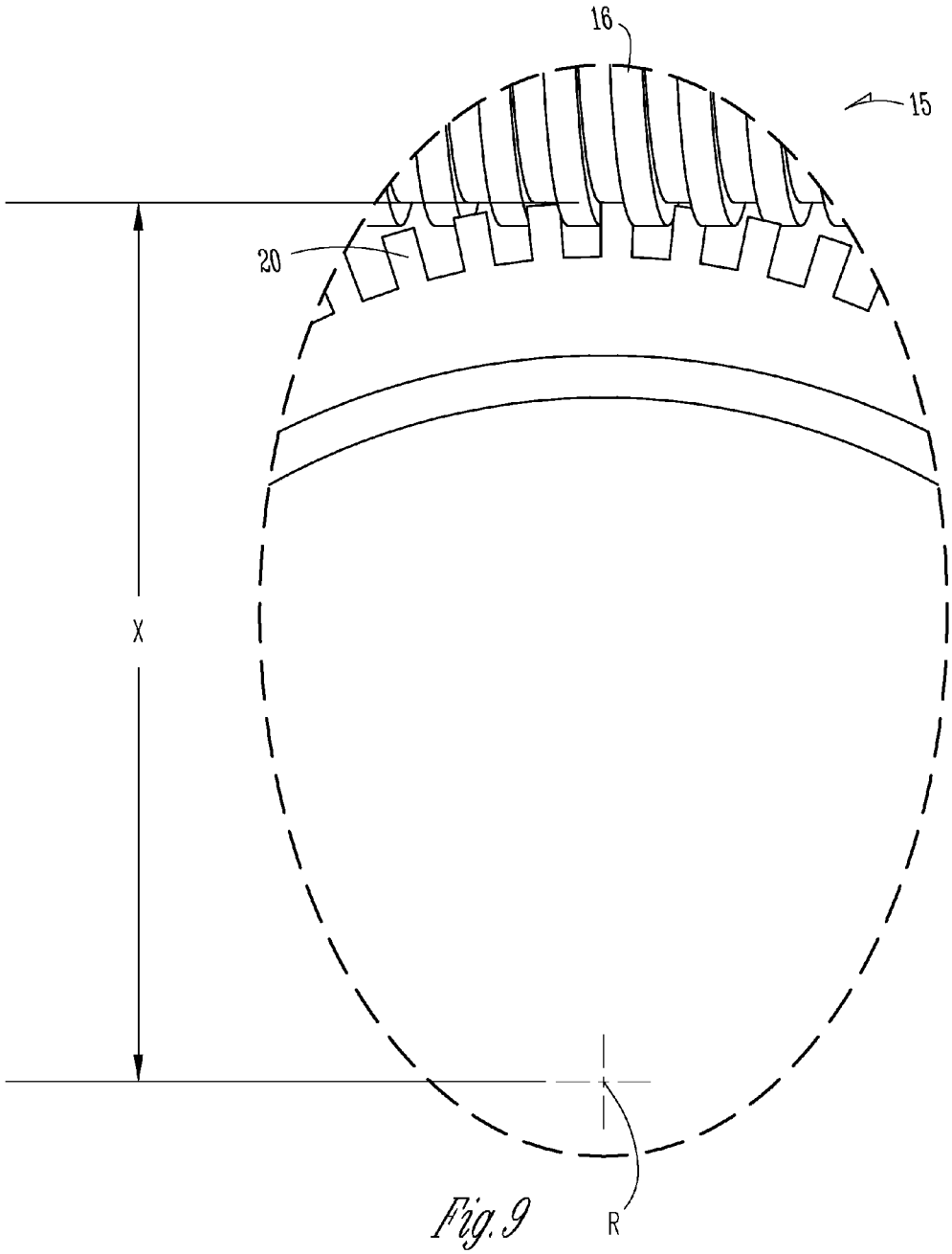
FIG. 9 is a further enlarged view of the example adjustment mechanism shown in FIG. 5.

The teeth 20 on the second gear 18 act somewhat like a cam surface so that the backlash within the first and second gears 16, 18 is minimized when the fin 14 is in the neutral position (see FIGS. 2, 5 and 9). The teeth 20 on the second gear 18 are also configured so that the backlash within the first and second gears 16, 18 increases as the fin 14 is adjusted from the neutral position to an angled position (see FIGS. 3-4, 6-7 and 9-11).

Therefore, the second gear 18 provides more control by reducing backlash when the fin 14 is in the neutral position and allows more backlash (i.e., clearance) as the fin 14 moves from the neutral position to reduce the chance of binding due to higher aerodynamic loads. The control is maintained even when the backlash is greater because on either side of the neutral position, the aerodynamic load serves to maintain pressure on the first and second gears 16, 18 to reduce the effect of backlash on the adjustment mechanism 14.

Figure 8:
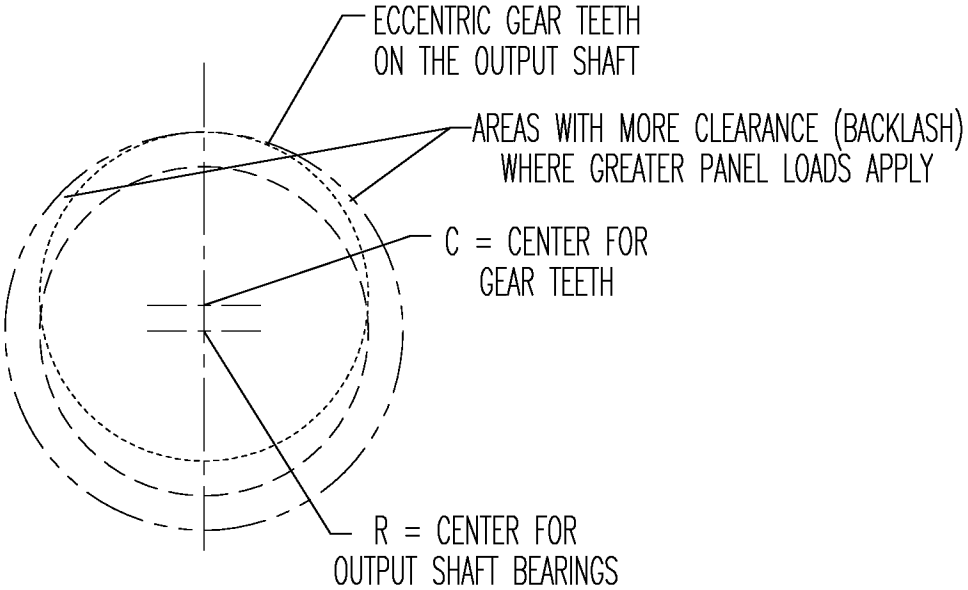
FIG. 8 is a schematic side view of an example gear system that may be used in an adjustment mechanism that maneuvers a fin on a projectile in accordance with some embodiments.

FIG. 8 schematically shows how the gear teeth may be made eccentric relative to an axis of rotation R for a shaft that supports the second gear 18. The gear teeth may be in a circular arc with the center point C of the arc being offset relative to an axis of rotation R of the second gear 18.

It should be noted that embodiments are contemplated where the first gear 16 has the eccentric gear teeth instead of the second gear 18 in order to provide control by reducing backlash when the fin 14 is in the neutral position and allowing more backlash (i.e., clearance) as the fin 14 moves from the neutral position. The eccentric gear teeth in the first or second gears 16, 18 may be fabricated by cutting such that the design provides a lower cost alternative to maintaining higher tolerances within the first and second gears 16, 18 of the adjustment mechanism 14.

In the illustrated example embodiments, the first gear 16 is a worm gear and the second gear 18 is a sector gear, although other types of gear connections may be used. In some embodiments, the first gear 16 may rotate clockwise and/or counter-clockwise as the fin 14 is adjusted relative to the casing 12 (compare FIGS. 6 and 7). In addition, the second gear 18 may rotate clockwise and/or counter-clockwise as the fin 14 is adjusted relative to the casing 12 (compare FIGS. 6 and 7 and also compare FIGS. 10 and 11).

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

The invention claimed is:

1. A projectile comprising:

a casing;

a drive inside the casing;

a fin; and an adjustment mechanism inside the casing, the adjustment mechanism including a first gear that engages the drive and a second gear that engages the fin and the first gear, wherein the second gear includes teeth that have respective outside radiuses that are different distances from an axis of rotation of the second gear.

2. The projectile of claim 1, wherein said first gear is a worm gear and said second gear is a sector gear.

3. The projectile of claim 1, wherein the drive is a motor.

4. The projectile of claim 1, wherein the projectile is a missile.

5. The projectile of claim 1, wherein the second gear has outer teeth and inner teeth and said inner teeth have greater radii than said outer teeth and when the fin is aligned with a flight axis of the projectile said inner teeth are engaged with said first gear.

6. The projectile of claim 5, wherein when the fin is maneuvered away from the flight axis of the projectile the outer teeth are engaged with said first gear.

7. The projectile of claim 1, wherein the first gear rotates clockwise and counter-clockwise as the fin is adjusted relative to the casing, and wherein the second gear rotates clockwise and counter-clockwise as the fin is adjusted relative to the casing.

* * * * *